US009154885B2

(12) United States Patent
Kushima et al.

(10) Patent No.: US 9,154,885 B2
(45) Date of Patent: Oct. 6, 2015

(54) SOUND GENERATOR, SOUND GENERATION DEVICE, AND ELECTRONIC APPARATUS

(71) Applicant: KYOCERA Corporation, Kyoto-shi, Kyoto (JP)

(72) Inventors: Noriyuki Kushima, Kirishima (JP); Shuichi Fukuoka, Kirishima (JP); Takeshi Hirayama, Kirishima (JP); Masato Murahashi, Aira (JP); Hiroshi Ninomiya, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 14/349,432

(22) PCT Filed: Aug. 12, 2013

(86) PCT No.: PCT/JP2013/071834
§ 371 (c)(1),
(2) Date: Apr. 3, 2014

(87) PCT Pub. No.: WO2014/025061
PCT Pub. Date: Feb. 13, 2014

(65) Prior Publication Data

US 2015/0036846 A1 Feb. 5, 2015

(30) Foreign Application Priority Data

Aug. 10, 2012 (JP) ..... 2012-179067

(51) Int. Cl.
*H04R 25/00* (2006.01)
*H04R 17/00* (2006.01)

(52) U.S. Cl.
CPC ..... *H04R 17/00* (2013.01); *H04R 2499/11* (2013.01)

(58) Field of Classification Search
CPC ..... H04R 17/00; H04R 7/04; H04R 7/16; H01L 29/84
See application file for complete search history.

(56) References Cited

U.S. PATENT DOCUMENTS

| | | | | |
|---|---|---|---|---|
| 2004/0201326 | A1* | 10/2004 | Yokoi et al. | 310/348 |
| 2007/0228893 | A1* | 10/2007 | Yamauchi et al. | 310/348 |
| 2013/0094681 | A1* | 4/2013 | Fukuoka et al. | 381/190 |

FOREIGN PATENT DOCUMENTS

| | | | |
|---|---|---|---|
| JP | 2001-119790 | A | 4/2001 |
| JP | 2001-275187 | A | 10/2001 |
| JP | 2002-511682 | A | 4/2002 |
| JP | 2012-060513 | A | 3/2012 |
| JP | 2012-110018 | A | 6/2012 |
| WO | 99/52324 | A1 | 10/1999 |

OTHER PUBLICATIONS

International Search Report, PCT/JP2013/071834, Oct. 29, 2013, 1 pg.
Japanese Office Action with English concise explanation, Japanese Patent Application No. 2014-511626, Nov. 28, 2014, 4 pgs.

* cited by examiner

*Primary Examiner* — Tuan D Nguyen
(74) *Attorney, Agent, or Firm* — Volpe and Koenig, P.C.

(57) ABSTRACT

Provided are a sound generator including a frame body, a vibration body provided to the frame body in a state where a tensile force is applied to the vibration body, and a piezoelectric vibration element provided to the vibration body. In the sound generator, when a first direction and a second direction are directions along a main surface of the vibration body and intersect with each other, the tensile force in the first direction and the tensile force in the second direction are different from each other. A sound generation device and an electronic apparatus including the sound generator are also provided.

9 Claims, 6 Drawing Sheets

SOUND GENERATOR, SOUND GENERATION DEVICE, AND ELECTRONIC APPARATUS

FIELD OF INVENTION

The disclosed embodiments relate to a sound generator, a sound generation device, and an electronic apparatus.

BACKGROUND

Conventionally, known are piezoelectric speakers as small-sized thin sound generators. As the piezoelectric speaker, there is exemplified a piezoelectric speaker including a rectangular frame body, a film provided in the frame body, and a piezoelectric vibration element provided on the film (for example, see Patent Literature 1).

CITATION LIST

Patent Literature

Patent Literature 1: Japanese Patent Application Laid-open No. 2012-60513

SUMMARY

Technical Problem

The piezoelectric speaker disclosed in Patent Literature 1 has the following problem. That is, a peak (portion having a sound pressure higher than its vicinity) and a dip (portion having a sound pressure lower than its vicinity) are generated in the frequency characteristic of the sound pressure due to a resonance phenomenon, and drastic variation of the sound pressure with frequency occurs.

An aspect of embodiments has been made in view of the above-mentioned circumstances and an object thereof is to provide a sound generator with small variation of sound pressure with frequency, and a sound generation device and an electronic apparatus including the sound generator.

Solution to Problem

Advantageous Effects of Invention

With the sound generator according to the aspect of embodiments, a sound generator with small variation of sound pressure with frequency can be obtained.

DETAILED DESCRIPTION OF THE PREFERRED EMBODIMENTS

Hereinafter, described are embodiments of a sound generator, a sound generation device, and an electronic apparatus that are disclosed by the present application with reference to the accompanying drawings. It should be noted that the invention is not limited by the respective embodiments below.

(First Embodiment)

Figure 1A:
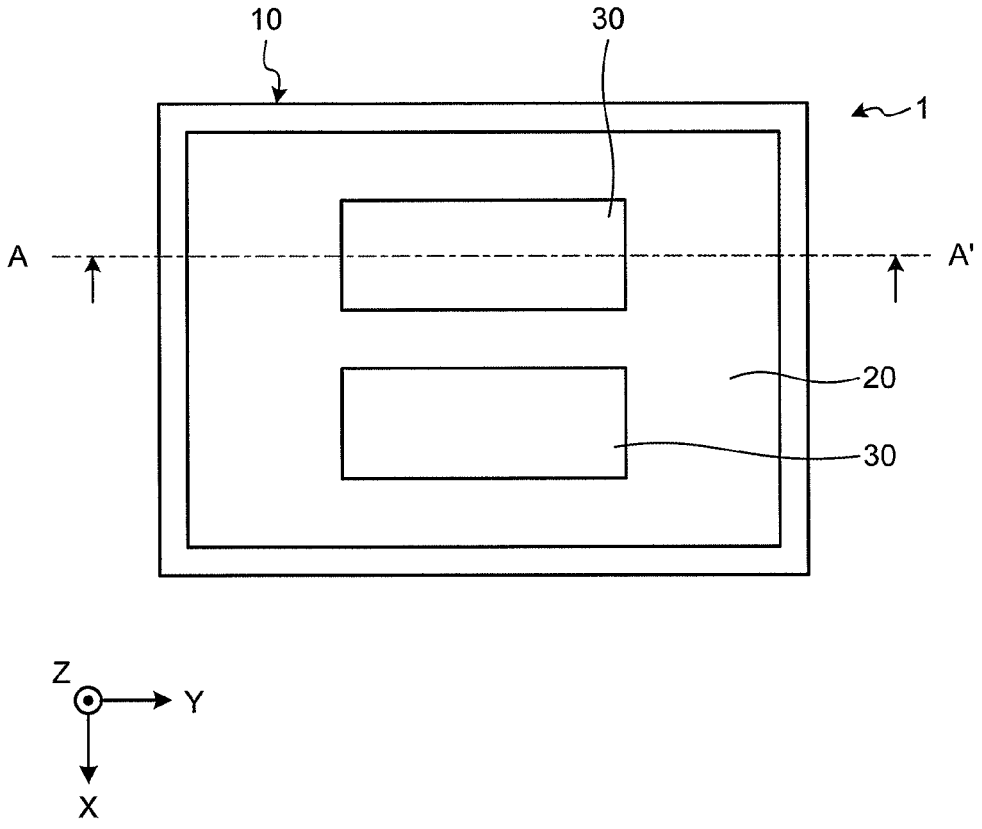
FIG. 1A is a plan view schematically illustrating a sound generator according to a first embodiment.
Figure 1B:
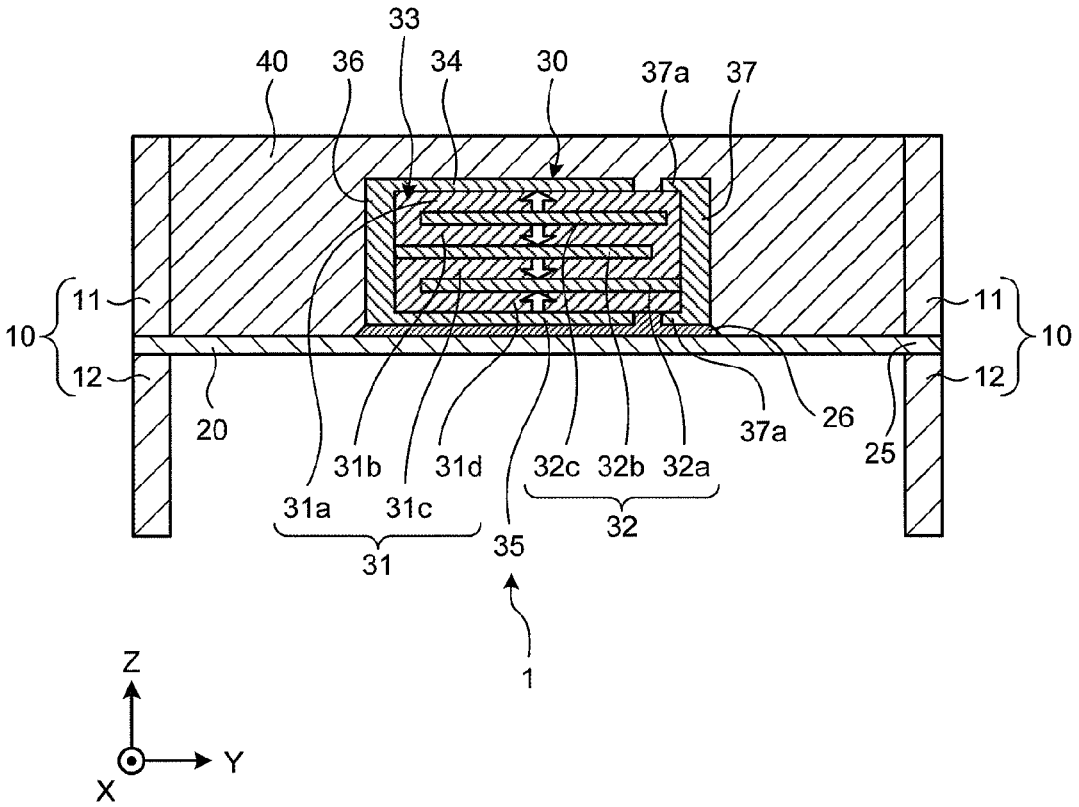
FIG. 1B is a sectional view cut along the line A-A' in FIG. 1A.

The configuration of a sound generator 1 in the first embodiment is described with reference to FIG. 1A and FIG. 1B. FIG. 1A is a plan view illustrating the sound generator 1 in the first embodiment when seen from the thickness direction (direction perpendicular to a main surface, +Z direction in FIG. 1A) of a vibration body 20. FIG. 1B is a sectional view cut along the line A-A' in FIG. 1A. For easy understanding, FIG. 1A illustrates a state where a resin layer 40 is seen through and FIG. 1B illustrates the sound generator 1 in an enlarged manner in the Z-axis direction.

As illustrated in FIG. 1A and FIG. 1B, the sound generator 1 in the embodiment includes a frame body 10, a vibration body 20 provided in the frame body 10 in a state where a tensile force is applied thereto, and two piezoelectric vibration elements 30 provided on the vibration body 20.

As illustrated in FIG. 1B, the frame body 10 includes a first frame member 11 and a second frame member 12 having the same shape (rectangular frame shape). The peripheral edge portion of the vibration body 20 is held and fixed between the first frame member 11 and the second frame member 12. The frame body 10 fixes the vibration body 20 in a state of applying a predetermined tensile force to the vibration body 20. That is, the vibration body 20 is provided (stretched) on the frame body 10 in a state where the tensile force is applied thereto. Thus, the vibration body 20 is provided in the frame body 10 so as to vibrate.

The material of the frame body 10 is not limited to a particular material and various materials can be used such as a metal, plastic, glass, ceramic, and wood. For example, stainless steel can be used preferably as the material of the frame body 10, because it is excellent in mechanical strength and corrosion resistance. Furthermore, the thickness of the frame body 10 is not also limited and can be set as appropriate depending on the situation. For example, the thickness of the frame body 10 can be set to approximately 100 μm to 1000 μm. The frame body 10 does not necessarily include the frame member 11 and the frame member 12. For example, the frame body 10 may include the frame member 11 only. In this case, for example, it is sufficient that the vibration body 20 is bonded to the surface of the frame member 11 in the −Z direction with an adhesive or the like.

The vibration body 20 is formed by a resin film. Preferable examples of the resin film forming the vibration body 20 include resin films made of polyethylene, polyimide, and the like. The thickness thereof can be set to 10 μm to 200 μm, for example. The vibration body 20 is not limited to be formed by the resin film and can be made of various existing materials such as a rubber and a metal.

The upper and lower main surfaces of the piezoelectric vibration elements 30 have rectangular plate-like shapes. Each piezoelectric vibration element 30 includes a laminated body 33, surface electrode layers 34 and 35, first to third external electrodes. The laminated body 33 is formed by laminating four piezoelectric layers 31 (31*a*, 31*b*, 31*c*, and 31*d*) and three internal electrode layers 32 (32*a*, 32*b*, and 32*c*) alternately. The surface electrode layers 34 and 35 are formed on both the upper and lower surfaces of the laminated body 33. The first to the third external electrodes are provided on ends of the laminated body 33 in the lengthwise direction (Y-axis direction) thereof.

A first external electrode 36 is arranged on the end of the laminated body 33 in the −Y direction. The first external electrode 36 is connected to the surface electrode layers 34 and 35, and the internal electrode layer 32*b*. A second external electrode 37 and the third external electrode (not illustrated) are arranged on the end of the laminated body 33 in the +Y direction so as to be spaced from each other in the X-axis direction. The second external electrode 37 is connected to the internal electrode layer 32*a* and the third external electrode (not illustrated) is connected to the internal electrode 32*c*.

The upper and lower ends of the second external electrode 37 extend to the upper and lower surfaces of the laminated body 33 and folded external electrodes 37*a* are formed thereon. These folded external electrodes 37*a* extend so as to be separated from the surface electrode layers 34 and 35 formed on the surfaces of the laminated body 33 with predetermined distances therebetween such that they do not make contact with the surface electrode layers 34 and 35. In the same manner, the upper and lower ends of the third external electrode (not illustrated) extend to the upper and lower surfaces of the laminated body 33 and folded external electrodes (not illustrated) are formed thereon. These folded external electrodes (not illustrated) extend so as to be separated from the surface electrode layers 34 and 35 formed on the surfaces of the laminated body 33 with predetermined distances therebetween such that they do not make contact with the surface electrode layers 34 and 35.

The piezoelectric layers 31 (31*a*, 31*b*, 31*c*, and 31*d*) are polarized in the directions as indicated by arrows in FIG. 1B. Voltages are applied to the first external electrode 36, the second external electrode 37, and the third external electrode in the following manner. That is, the voltages are applied thereto such that when the piezoelectric layers 31*a* and 31*b* contract, the piezoelectric layers 31*c* and 31*d* expand whereas when the piezoelectric layers 31*a* and 31*b* expand, the piezoelectric layers 31*c* and 31*d* contract. Thus, each piezoelectric vibration element 30 is a bimorph-type piezoelectric element, and shows bending vibrations in the Z-axis direction such that its amplitude changes in the Y-axis direction when it receives an electric signal.

Existing piezoelectric ceramics such as lead zirconate (PZ), lead zirconate titanate (PZT), a Bi-layered compound, and a lead-free piezoelectric material like a tungsten bronze structure compound can be used as the piezoelectric layers 31. The thicknesses of the piezoelectric layers 31 can be set as appropriate in accordance with desired vibration characteristics. For example, the thicknesses of the piezoelectric layers 31 can be set to 10 μm to 100 μm in terms of low-voltage driving.

The internal electrode layers 32 can be made of various existing conductive materials. For example, the internal electrode layers 32 can contain a metal component made of silver and palladium and a material component forming the piezoelectric layers 31. The internal electrode layers 32 contain the ceramic component forming the piezoelectric layers 31, so that a stress due to a difference in the thermal expansion between the piezoelectric layers 31 and the internal electrode layers 32 can be reduced. The internal electrode layers 32 may not contain the metal component made of silver and palladium, or may not contain the material component forming the piezoelectric layers 31.

The surface electrode layers 34 and 35 and the first to the third external electrodes can be made of various existing conductive materials. For example, they can contain a metal component made of silver and a glass component. Thus, the surface electrode layers 34 and 35 and the first to the third external electrodes contain the glass component, so that strong adhesion forces between the surface electrode layers 34 and 35 and the first to the third external electrode and the piezoelectric layers 31 and the internal electrode layers 32 can be obtained. Note that they are not limited to contain the glass component.

Furthermore, the main surface of the piezoelectric vibration element 30 at the vibration body 20 side is bonded to the vibration body 20 with an adhesive layer 26. The thickness of the adhesive layer 26 is desirably equal to or smaller than 20 μm, more desirably equal to or smaller than 10 μm. When the thickness of the adhesive layer 26 is equal to or smaller than 20 μm, the vibration of the laminated body 33 is easily transmitted to the vibration body 20.

An adhesive for forming the adhesive layer 26 can be made of well-known materials such as epoxy-based resins, silicon resins, and polyester-based resins. As a method of curing the resin to be used for the adhesive, any of thermal curing, photo-curing, and anaerobic curing may be used.

Furthermore, in the sound generator 1 in the embodiment, a cover layer formed by the resin layer 40 covers at least a part of the surface of the vibration body 20. To be specific, in the sound generator 1 in the embodiment, a resin is filled at the inner side of the frame member 11 so as to embed therein the vibration body 20 and the piezoelectric vibration elements 30, and the resin layer 40 is formed by the filled resin.

The resin layer 40 can be formed by an epoxy-based resin, an acryl-based resin, a silicon-based resin, a rubber, or the like. In consideration of suppression of the peak and dip, the resin layer 40 preferably covers the piezoelectric vibration elements 30 completely but may not cover the piezoelectric vibration elements 30 completely. Furthermore, the resin layer 40 may not necessarily cover the vibration body 20 overall and it is sufficient that the resin layer 40 is provided so as to cover a part of the main surface of the vibration body 20. The thickness of the resin layer 40 can be set as appropriate. For example, the thickness of the resin layer 40 can be set to approximately 0.1 mm to 1 mm. The resin layer 40 may not be provided in some cases.

Resonance of the vibration body 20 can be damped by providing the resin layer 40 as described above. This can suppress the peak and the dip in the frequency characteristic of the sound pressure that are generated due to the resonance phenomenon, thereby reducing variation of the sound pressure with frequency.

In the sound generator 1 in the embodiment, the vibration body 20 is fixed to the frame body 10 in the state where the tensile force is applied thereto. The tensile force that is applied to the vibration body 20 is not isotropic but is different depending on the directions. That is, when the lengthwise direction of the vibration body 20 (Y-axis direction) is defined as the first direction and the width direction (X-axis direction) of the vibration body 20 is defined as the second direction, a tensile force T1 in the first direction and a tensile force T2 in the second direction are different. This can suppress the peak and the dip that are generated on the frequency characteristic of the sound pressure due to the resonance of the vibration body 20, thereby obtaining a sound generator with small variation of the sound pressure with frequency. It is supposed that this effect can be obtained because the tensile force applied to the vibration body 20 is made different depending on the directions, which lowers symmetry in the vibration of the vibration body 20, so that the degenerated resonance mode is dispersed. Although the first direction and the second direction are orthogonal to each other in the embodiment, it is sufficient that the first direction and the second direction are along the main surface of the vibration body 20 (surface perpendicular to the thickness direction) and intersect with each other.

Although both the tensile force T1 and the tensile force T2 desirably take values larger than 0 over the entire temperature range in which the sound generator 1 is expected to be used, it is sufficient that at least one of the tensile force T1 and the tensile force T2 takes a value larger than 0.

Figure 2A:
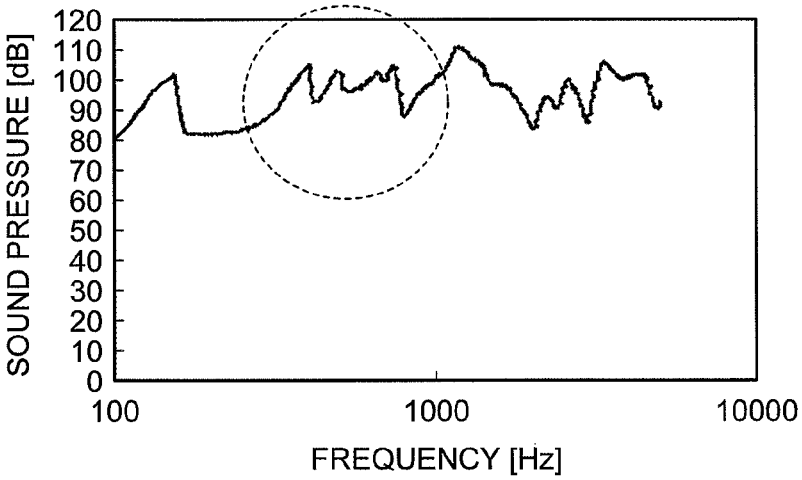
FIG. 2A is a graph illustrating an example of frequency dependence of the sound pressure in the sound generator.
Figure 2B:
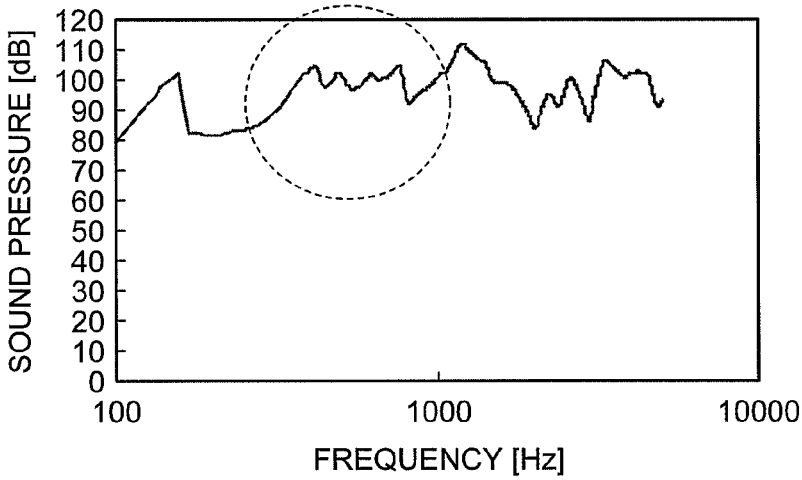
FIG. 2B is a graph illustrating another example of frequency dependence of the sound pressure in the sound generator.

FIG. 2A and FIG. 2B are graphs illustrating examples of the frequency characteristic (frequency dependence) of the sound pressure in the sound generator 1. In these graphs, the transverse axis indicates the frequency and the longitudinal axis indicates the sound pressure. To be specific, FIG. 2A illustrates the frequency characteristic of the sound pressure when both the tensile force T1 in the first direction (Y-axis direction) and the tensile force T2 in the second direction (X-axis direction) are set to 18 MPa in the sound generator 1 as illustrated in FIG. 1A. FIG. 2B illustrates the frequency characteristic of the sound pressure when the tensile force T1 in the Y-axis direction is set to 18 MPa and the tensile force T2 in the X-axis direction is set to 10.5 MPa in the sound generator 1 as illustrated in FIG. 1A.

When FIG. 2A and FIG. 2B are compared with each other, there is little difference in the overall sound pressure in the frequency range of 100 Hz to 10,000 Hz.

FIG. 2B indicates that the variation of the sound pressure with the frequency is smaller particularly in the frequency region of 600 to 1,000 Hz surrounded by a dashed line in the graph in comparison with that in the graph as illustrated in FIG. 2A. It is needless to say that optimum values of the tensile forces T1 and T2 and an optimum ratio between the tensile force T1 and the tensile force T2 are different depending on the materials and shapes of the vibration body 20 and the piezoelectric vibration elements 30.

Next, an example of a method of manufacturing the sound generator 1 in the embodiment is described. The piezoelectric vibration elements 30 are prepared initially. First, a binder, a dispersant, a plasticizer, and a solvent are kneaded into powder of a piezoelectric material so as to produce slurry. As the piezoelectric material, any of lead-based and lead-free materials can be used.

Subsequently, a green sheet is produced by shaping the slurry into a sheet form. Then, a conductive paste is printed on the green sheet so as to form a conductive pattern serving as the internal electrode. Three green sheets on which the electrode patterns are formed are laminated on one another and a green sheet on which the electrode pattern is not printed is laminated thereon so as to produce a laminated formed body. Then, the laminated formed body is degreased, sintered, and cut into a predetermined dimension so as to obtain the laminated bodies 33.

Thereafter, the outer peripheral portion of each laminated body 33 is processed if necessary. The conductive pastes for forming the surface electrode layers 34 and 35 are printed on both the main surfaces of the laminated body 33 in the laminate direction. Subsequently, the conductive pastes for forming the first to the third external electrodes are printed on both the end surfaces of each laminated body 33 in the lengthwise direction (Y-axis direction). Then, the electrodes are baked at a predetermined temperature. In this manner, the piezoelectric vibration elements 30 as illustrated in FIG. 1A and FIG. 1B can be obtained.

To give a piezoelectric property to each piezoelectric vibration element 30, a direct-current voltage is applied thereto through the first to the third external electrodes so as to polarize the piezoelectric layers 31 of each piezoelectric vibration element 30. The DC voltage is applied such that the polarization is performed in the directions as indicated by the arrows in FIG. 1B.

Then, the resin film forming the vibration body 20 is prepared and fixed in a state where a tensile force is applied thereto by stretching the ends of the resin film. In this case, the tensile force T1 in the first direction and the tensile force T2 in the second direction are made different. The resin film in the state where the tensile forces are applied thereto is fixed by holding it between the frame members 11 and 12. Then, portions of the resin film that protrude to the outer sides of the frame body 10 are removed. In this manner, the vibration body 20 attached to the frame body 10 in the state where the tensile forces are applied thereto is formed. Thereafter, the adhesive forming as the adhesive layer 26 is applied onto the vibration body 20. The piezoelectric vibration elements 30 at the surface electrode 34 sides are pressed against the vibration body 20. Then, the adhesive is cured by irradiating it with heat or ultraviolet rays. The resin before cured is made to flow into the frame member 11, and then, is cured so as to form the resin layer 40. The sound generator 1 in the embodiment can be manufactured as described above.

Figure 3A:
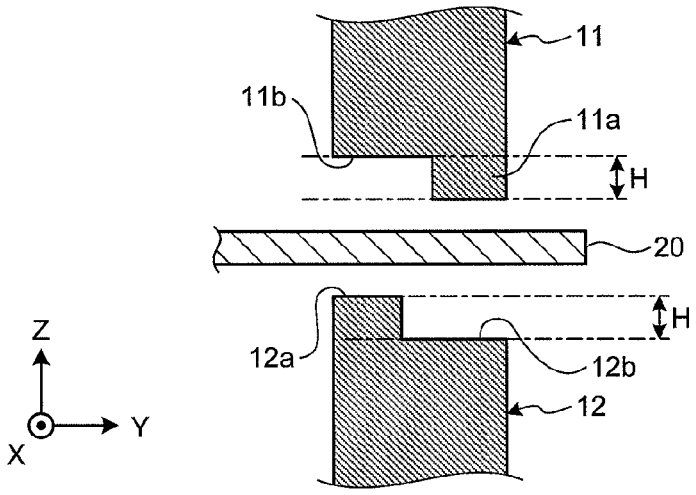
FIG. 3A is a view for explaining an example of a method of fixing a vibrating plate to a frame body.
Figure 3B:
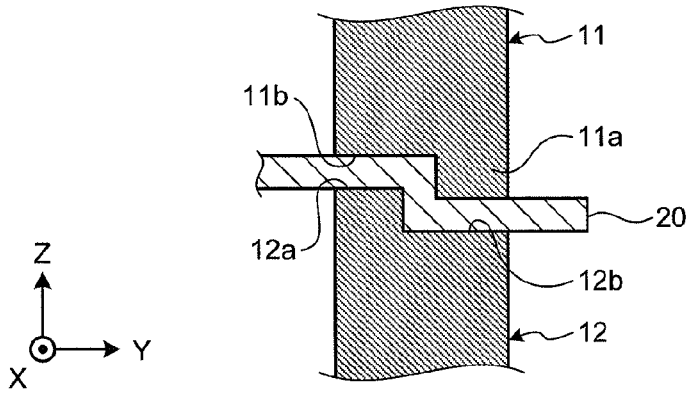
FIG. 3B is a view for explaining another example of the method of fixing the vibrating plate to the frame body.
Figure 3C:
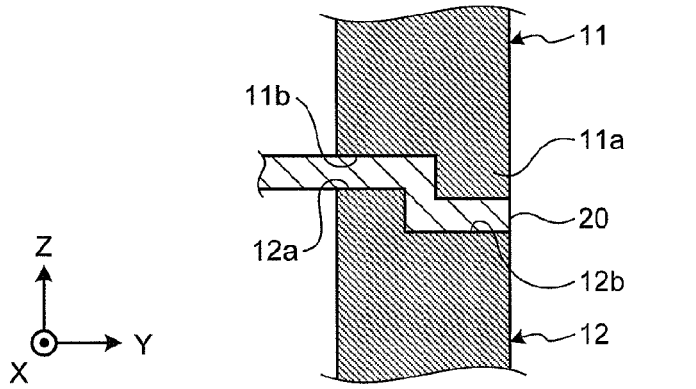
FIG. 3C is a view for explaining still another example of the method of fixing the vibrating plate to the frame body.

Next, another example of the method of fixing the vibration body 20 to the frame body 10 in the state where the tensile force is applied thereto is described with reference to FIG. 3A to FIG. 3C. FIG. 3A to FIG. 3C are partial sectional views for explaining another example of the method of fixing the vibration body 20 to the frame body 10 in the state where the tensile force is applied thereto. FIG. 3A to FIG. 3C illustrate only one end of the vibration body 20, the frame member 11, and the frame member 12 included in the sound generator in the Y-axis direction partially. The sound generator is the same as the sound generator 1 as illustrated in FIG. 1A and FIG. 1B other than a point that the frame member 11 has irregularities formed by protrusions 11*a* and recesses 11*b* and the frame member 12 has irregularities formed by protrusions 12*a* and recesses 12*b*. The irregularities formed by the protrusions 11*a* and the recesses 11*b* are formed on only both the ends of portions (ends in the −Z direction) of the frame member 11 that make contact with the vibration body 20 in the Y-axis direction. The irregularities formed by the protrusions 12*a* and the recesses 12*b* are formed on only both the ends of portions (ends in the Z direction) of the frame member 12 that make contact with the vibration body 20 in the Y-axis direction.

First, as illustrated in FIG. 3A, the frame member 11 and the frame member 12 are arranged so as to be spaced from each other. In this case, the frame member 11 and the frame member 12 are arranged such that the protrusions 11*a* of the frame member 11 and the recesses 12*b* of the frame member 12 face each other and the recesses 11*b* of the frame member 11 and the protrusions 12*a* of the frame member 12 face each other. Then, the resin film forming the vibration body 20 is set between the frame member 11 and the frame member 12. In this case, both the ends of the resin film in the Y-axis direction is fixed while a tensile force T3 is applied to the resin film only in the Y-axis direction.

Next, as illustrated in FIG. 3B, the resin film of which both the ends in the Y-axis direction are fixed in the state where the tensile force T3 is applied thereto in the Y-axis direction is fixed by holding it between the frame member 11 and the frame member 12. In this case, the resin film is fixed such that it is held between the protrusions 11*a* of the frame member 11 and the recesses 12*b* of the frame member 12 and between the recesses 11*b* of the frame member 11 and the protrusions 12*a* of the frame member 12. With this, the resin film is stretched in the Y-axis direction and a tensile force T4 in the Y-axis direction is further added to the resin film forming the vibration body 20.

Then, as illustrated in FIG. 3C, unnecessary portions of the resin film that protrude to the outer sides of the frame member 11 and the frame member 12 are removed. In this manner, the vibration body 20 can be fixed to the frame body 10 including the frame member 11 and the frame member 12 in the state where the tensile force is applied thereto. In this case, the tensile force T1 applied to the vibration body 20 in the Y-axis direction is T1=T3+T4.

The vibration body 20 is fixed to the frame body 10 in this manner, so that a desired tensile force having a sufficient magnitude can be applied to the vibration body 20 easily and reliably and lowering of the tensile force to the vibration body 20 over time can be reduced. The irregularities may be formed not on both the ends of the frame member 11 and the frame member 12 in the Y-axis direction but on only one end of each of the frame members in the Y-axis direction. Furthermore, irregularities may be also formed on the ends thereof in the X-axis direction.

That is, the sound generator is configured in such a manner that the frame body 10 includes the frame member 11 and the frame member 12, the peripheral edge portion of the vibration body 20 is held and fixed between the frame member 11 and the frame member 12, the irregularities are provided on the frame member 11 and the frame member 12, and at least a part of the peripheral edge portion of the vibration body 20 is held between the recesses and the protrusions of the irregularities. This can provide a sound generator with small variation of the sound pressure with frequency and lowered characteristic deterioration due to use over the years.

The irregularities may be formed not only on the ends of the frame member 11 and the frame member 12 in the Y-axis direction but also on the ends thereof in the X-axis direction and the sizes (differences in the height between the protrusions and the recesses indicated by a reference symbol H in FIG. 3A) of the irregularities on the ends thereof in the Y-axis direction may be different. In this case, the vibration body 20 is stretched in both the X-axis direction and the Y-axis direction by holding the vibration body 20 between the frame member 11 and the frame member 12. That is, the tensile forces in both the X-axis direction and the Y-axis direction are applied to the vibration body 20. In addition, the frame member 11 and the frame member 12 hold the vibration body 20 therebetween, so that the tensile force applied to the vibration body 20 is different between the X-axis direction and the Y-axis direction. Based on this, the tensile forces having different magnitudes can be applied to the vibration body 20 in the X-axis direction and the Y-axis direction only by holding the vibration body 20 between the frame member 11 and the frame member 12. This can provide a sound generator with small variation of the sound pressure with frequency and lowered characteristic deterioration due to use over the years.

That is, the sound generator is configured in such a manner that the irregularities are provided on ends in both the first direction and the second direction, and the irregularities provided on the ends in the first direction and the irregularities provided on the ends in the second direction among these irregularities have different sizes. This can provide a sound generator with small variation of the sound pressure with frequency and lowered characteristic deterioration due to use over the years. It is sufficient that the irregularities are provided on at least one end in the first direction and at least one end in the second direction.

A method of making the tensile force T1 in the first direction and the tensile force T2 in the second direction on the vibration body 20 different is not limited to the above-mentioned method. It is sufficient that the tensile force T1 in the first direction and the tensile force T2 in the second direction on the vibration body 20 are different in the state where the vibration body 20 is attached to the frame body 10 as a result, and any method can be employed.

Various methods can be also used as a method of checking that the tensile force T1 in the first direction and the tensile force T2 in the second direction on the vibration body 20 are different. Examples thereof include infrared spectroscopy as one method. For example, a method in which an absorbance ratio between two spectra obtained from parallel polarized light and perpendicular polarized light with respect to a specific direction are calculated for both the first direction and the second direction so as to be compared can be used. The state where the tensile force is not applied to the vibration body 20 is compared with the state where the vibration body 20 is stretched on the frame body 10 and the tensile force is applied thereto, whereby an influence of extension is removed when the resin film forming the vibration body 20 is manufactured, for example. Furthermore, for example, the absorbance ratio in the first direction and the absorbance ratio in the second direction are compared in the state where the tensile force is not applied to the vibration body 20 and the state where the vibration body 20 is stretched on the frame body 10 and the tensile force is applied thereto. If there is a difference between them, it can be checked that the tensile force T1 in the first direction and the tensile force T2 in the second direction on the vibration body 20 are different.

When the method is used, the vibration body 20 needs to be irradiated with infrared rays directly. When the vibration body 20 has a portion exposed to the outside, it is sufficient that the exposed portion of the vibration body 20 is irradiated with infrared rays. For example, when the resin layer 40 covers both the main surfaces of the vibration body 20, for example, it is sufficient that the exposed portion of the vibration body 20 is irradiated with infrared rays after removing the resin layer 40 by etching or the like.

Another method is exemplified as follows. An attachment having an anisotropic shape (shape long in a specific direction A) is attached to the front end of a tension meter. Then, a measured value when the attachment is pressed against the vibration body 20 in a state where the direction A is made identical to the first direction is compared with a measured value when the attachment is pressed against the vibration body 20 in a state where the direction A is made identical to the second direction. If there is a difference between the two measured values, it can be checked that the tensile force T1 in the first direction and the tensile force T2 in the second direction on the vibration body 20 are different. When the planar shape of the vibration body 20 is anisotropic and an influence thereby is expected, a part of the vibration body 20 is fixed by a frame body having the isotropic shape (for example, circular ring shape) and the attachment is pressed against the vibration body 20 in the frame so as to eliminate the influence thereby. When the resin layer 40 covers the main surfaces of the vibration body 20, for example, it is sufficient that the attachment is pressed against the vibration body 20 after removing the resin layer 40 by etching or the like.

Still another method is exemplified as follows. A figure is drawn on the main surface of the vibration body 20 in the state where the vibration body 20 is attached to the frame body 10. Then, a shape (shape 1) of the figure in that state is compared with a shape (shape 2) of the drawing in a state where the vibration body 20 is detached from the frame body 10 and the tensile force is set to substantially 0. If the shape 2 deforms in comparison with the shape 1, it can be checked that the tensile force applied to the vibration body 20 has anisotropy, that is, the tensile force T1 in the first direction and the tensile force T2 in the second direction are different.

The method of checking that the tensile force T1 in the first direction and the tensile force T2 in the second direction on the vibration body 20 are different is not limited to the above-mentioned methods. The checking can be made by using various other methods having validity. The checking is not required to be made by all the methods. It is sufficient that the tensile force T1 in the first direction and the tensile force T2 in the second direction can be checked to be different by any one method.

(Second Embodiment)

Figure 4A:
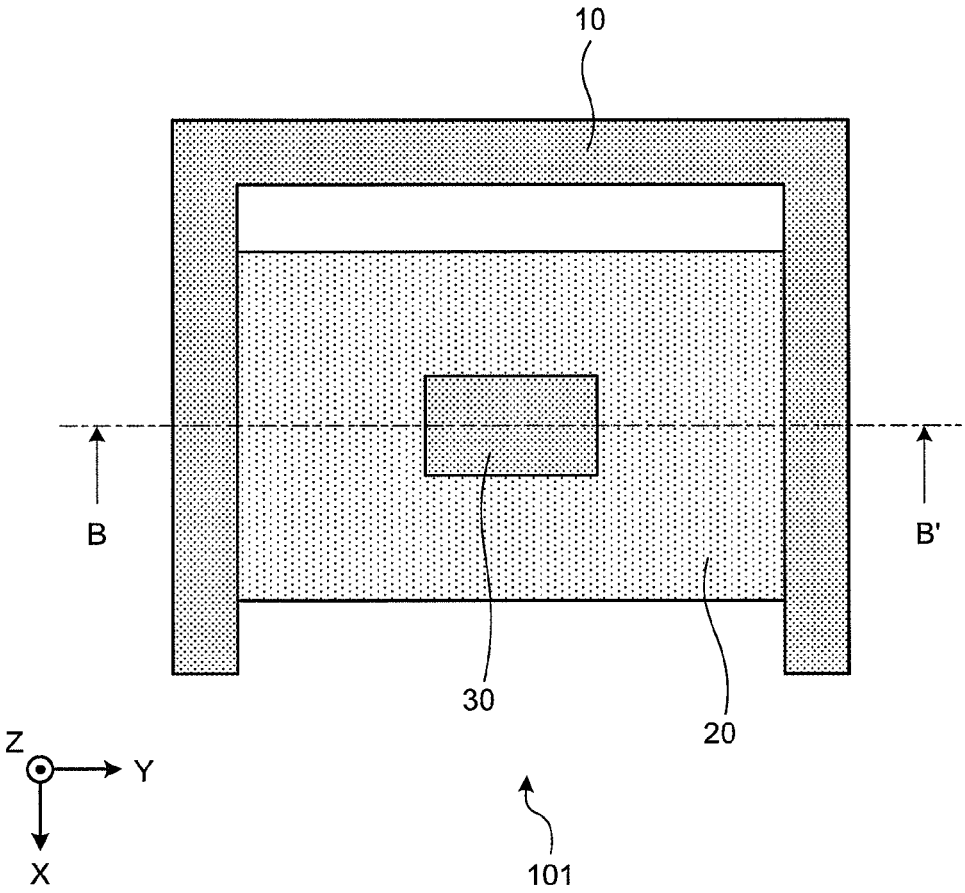
FIG. 4A is a plan view schematically illustrating a sound generator according to a second embodiment.
Figure 4B:
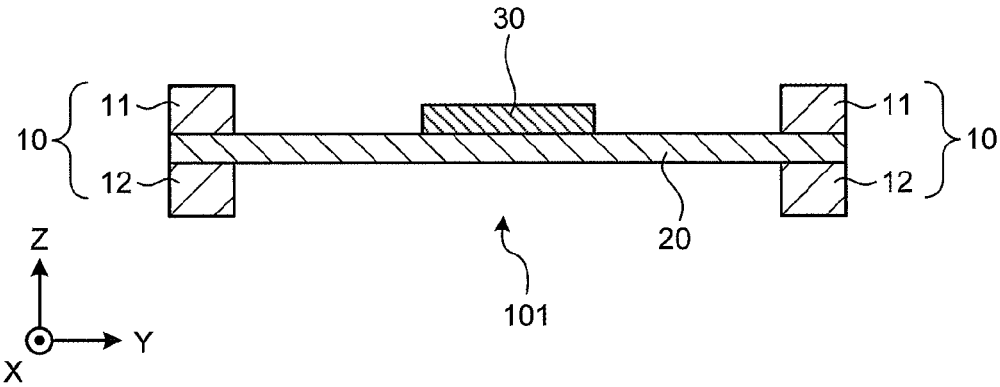
FIG. 4B is a sectional view cut along the line B-B' in FIG. 4A.

Next, the configuration of a sound generator 101 according to a second embodiment is described with reference to FIG. 4A and FIG. 4B. FIG. 4A is a plan view illustrating the sound generator 101 in the second embodiment when seen from the thickness direction (direction perpendicular to the main surface, +Z direction in FIG. 4A) of the vibration body 20. FIG. 4B is a sectional view cut along the line B-B' in FIG. 4A. For easy understanding, FIG. 4B illustrates the sound generator 101 in an enlarged manner in the Z-axis direction. In the embodiment, points different from those in the above-mentioned first embodiment are described, and the same reference numerals denote the same constituent components and detail description thereof is omitted.

As illustrated in FIG. 4A and FIG. 4B, the sound generator 101 in the embodiment does not include the resin layer 40. Furthermore, in the sound generator 101 in the embodiment, the frame body 10 including the frame member 11 and the frame member 12 has a U-like shape. Only both the ends of the vibration body 20 in the Y-axis direction are fixed to the frame body 10 while both the ends thereof in the X-axis direction are not fixed to the frame body 10. The tensile force in the Y-axis direction that is applied to the vibration body 20 is set to be larger than the tensile force in the X-axis direction.

That is, in the sound generator 101 in the embodiment, both the ends of the vibration body 20 in the first direction (Y-axis direction) are fixed to the frame body 10 while both the ends of the vibration body 20 in the second direction (X-axis direction) are not fixed to the frame body 10. With this, the tensile force in the first direction (Y-axis direction) that is applied to the vibration body 20 is made larger than the tensile force in the second direction (X-axis direction) easily. This can provide a sound generator with small variation of the sound pressure with frequency and lowered characteristic deterioration due to use over the years.

(Third Embodiment)

Figure 5:
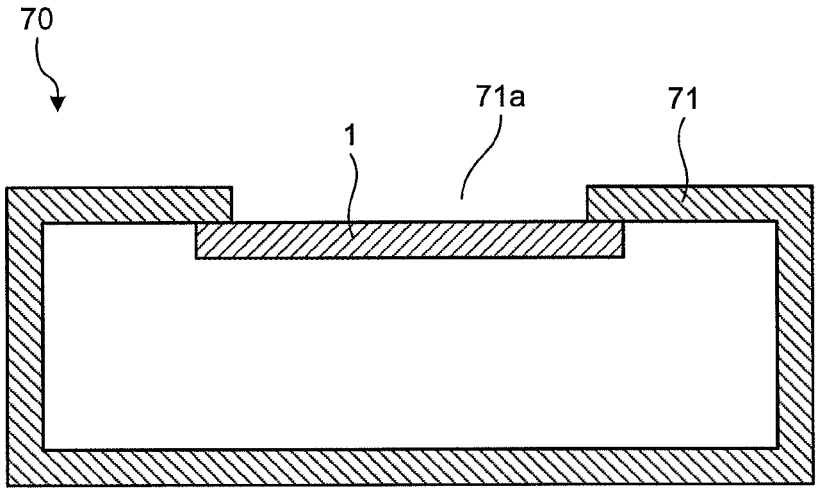
FIG. 5 is a view for explaining the configuration of a sound generation device according to a third embodiment.

Next, the configuration of a sound generation device 70 according to a third embodiment is described. FIG. 5 is a view illustrating an example of the configuration of the sound generation device 70 including the sound generator 1 in the above-mentioned first embodiment. In FIG. 5, only the constituent components necessary for description are illustrated and the configuration of the sound generator 1 and common constituent components are not illustrated.

The sound generation device 70 in the embodiment is a sound generation device such as a what-is-called speaker. As illustrated in FIG. 5, for example, the sound generation device 70 includes a housing 71 and the sound generator 1 attached to the housing 71. The housing 71 has a box-like shape of rectangular parallelepiped and has an opening 71*a* on one surface. The housing 71 can be made of an existing material such as plastic, a metal, and wood. The housing 71 is not limited to have the box-like shape of rectangular parallelepiped but may have various shapes such as a circular cylindrical shape and a frustum shape.

The sound generator 1 is attached to the opening 71*a* of the housing 71. The sound generator 1 corresponds to the sound generator 1 in the above-mentioned first embodiment, and description of the sound generator 1 is omitted. The sound generation device 70 having the configuration generates sound with the sound generator 1 generating high-quality sound with small variation of the sound pressure with frequency, thereby generating high-quality sound. The sound generation device 70 can resonate the sound generated from the sound generator 1 in the housing 71 so as to increase the sound pressure in a low-frequency band, for example. A place at which the sound generator 1 is attached can be set freely. Furthermore, the sound generator 1 may be attached to the housing 71 through another member.

(Fourth Embodiment)

Figure 6:
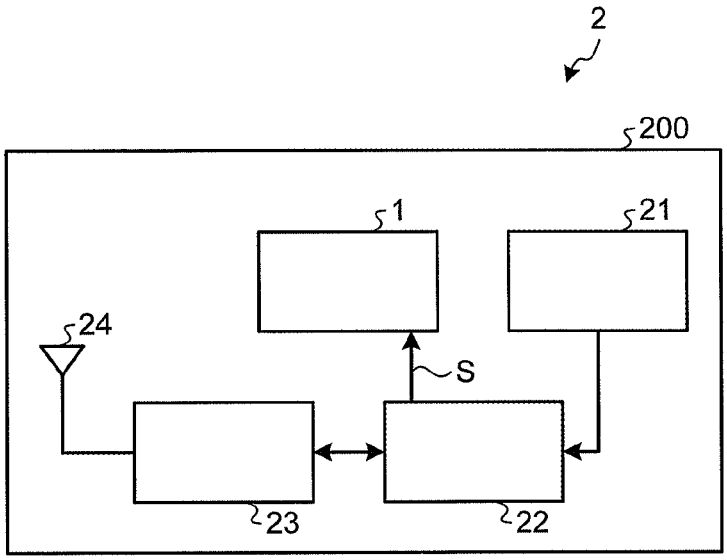
FIG. 6 is a view for explaining the configuration of an electronic apparatus according to a fourth embodiment.

Next, the configuration of an electronic apparatus according to a fourth embodiment is described. FIG. 6 is a view illustrating an example of the configuration of an electronic apparatus 2 including the sound generator 1 in the above-mentioned first embodiment. In FIG. 6, only the constituent components necessary for description are illustrated and the configuration of the sound generator 1 and common constituent components are not illustrated. The electronic apparatus 2 includes a housing 200, the sound generator 1 provided on the housing 200, and an electronic circuit connected to the sound generator 1.

To be specific, as illustrated in FIG. 6, the electronic apparatus 2 includes an electronic circuit including a control circuit 21, a signal processing circuit 22 and a communication circuit 23, an antenna 24, and the housing 200 accommodating these components. Other electric members (for example, devices such as a display and a microphone and circuits) included by the electronic apparatus 2 are not illustrated.

The communication circuit 23 receives a signal input from the antenna 24 and outputs it to the signal processing circuit 22. The signal processing circuit 22 processes the signal input from the communication circuit 23 to generate an audio signal S, and outputs it to the sound generator 1. The sound generator 1 generates sound based on the audio signal S. The control circuit 21 controls overall the electronic apparatus 2 including the signal processing circuit 22 and the communication circuit 23.

The electronic apparatus 2 having the configuration generates sound with the sound generator 1 capable of generating high-quality sound with small variation of the sound pressure with frequency, thereby generating high-quality sound.

Although the sound generator 1 is attached directly to the housing 200 of the electronic apparatus 2 in FIG. 6, the sound generator 1 is not limited to be attached in this manner. For example, the sound generation device 70 in which the sound generator 1 is attached to the housing 71 as illustrated in FIG. 5 may be attached to the housing 200 of the electronic apparatus 2.

The electronic apparatus 2 on which the sound generator 1 is mounted is not limited to conventionally well-known electronic apparatuses that generate sound, such as mobile phones, tablet terminals, televisions, and audio apparatuses. The electronic apparatus 2 on which the sound generator 1 is mounted may be electric products such as refrigerators, microwaves, vacuum cleaners, and washing machines.

(Modifications)

The invention is not limited to the above-mentioned embodiments and various changes or improvements can be made in a range without departing from a concept of the invention defined by the accompanying scope of the invention and equivalents thereof.

For example, although the vibration body 20 has a rectangular shape when seen from the above in the above-mentioned embodiments, the shape thereof is not limited thereto and the vibration body 20 may have various other shapes. For example, the vibration body 20 may have other polygonal shapes or shapes like ellipse.

Furthermore, although one piezoelectric vibration element 30 is arranged on the vibration body 20 in the above-mentioned embodiments, equal to or more than two piezoelectric vibration elements 30 may be arranged. Furthermore, although the piezoelectric vibration element 30 has the rectangular shape when seen from the above, it may have another shape such as an elliptical shape.

Although the what-is-called bimorph lamination-type piezoelectric vibration element 30 is employed in the above-mentioned embodiments, the piezoelectric vibration element 30 is not limited thereto. For example, the same effects can be obtained even by using a unimorph-type piezoelectric vibration element configured by bonding a plate such as a metal to one main surface of the piezoelectric vibration element that show stretching vibrations in the plane direction, instead of the bimorph-type piezoelectric vibration element. Alternatively, the piezoelectric vibration elements that show stretching vibrations in the plane direction may be provided to both the surfaces of the vibration body 20, that is, the unimorph-type or bimorph-type piezoelectric vibration elements may be provided to both the surfaces of the vibration body 20.

Furthermore, although the sound generator 1 in the first embodiment is used as the sound generator in the above-mentioned third and fourth embodiments, the sound generator is not limited thereto. Alternatively, the sound generator 101 in the second embodiment or sound generators in other modes may be used.

REFERENCE SIGNS LIST

1, 101 Sound generator
2 Electronic apparatus
10 Frame body
11, 12 Frame member
11*a*, 12*a* Protrusion
11*b*, 12*b* Recess
20 Vibration body
30 Piezoelectric vibration element
70 Sound generation device
71, 200 Housing

What is claimed is:

1. A sound generator comprising:
a frame body;
a vibration body provided in the frame body in a state where a tensile force is applied to the vibration body; and
a piezoelectric vibration element provided on the vibration body, wherein
when a first direction and a second direction are directions along a main surface of the vibration body and intersect with each other,
both ends in the first direction of the vibration body and both ends in the second direction of the vibration body are fixed to the frame body,
a length in the first direction of the vibration body is longer than a length in the second direction of the vibration body, and
the tensile force in the first direction is larger than the tensile force in the second direction.

2. The sound generator according to claim 1, wherein the first direction and the second direction are orthogonal to each other.

3. The sound generator according to claim 1, wherein at least a part of the main surface of the vibration body is covered by a cover layer.

4. The sound generator according to claim 1, wherein
the frame body includes a first frame member and a second frame member, and a peripheral edge portion of the vibration body is held and fixed between the first frame member and the second frame member, and
the first frame member and the second frame member have irregularities, and at least a part of the peripheral edge portion of the vibration body is held between recesses and protrusions of the irregularities.

5. The sound generator according to claim 4, wherein
the irregularities are provided on ends in both the first direction and the second direction, and
the irregularities provided on the end in the first direction have a size different that of the irregularities provided on the end in the second direction, among the irregularities.

6. The sound generator according to claim 1, wherein both ends of the vibration body in the first direction are fixed to the frame body, and both ends of the vibration body in the second direction are not fixed to the frame body.

7. The sound generator according to claim 1, wherein the vibration body has a rectangular shape, and an entire peripheral edge of the vibration body is fixed to the frame body.

8. A sound generation device comprising:
a housing; and
a sound generator being provided in the housing,
the sound generator comprising:
a frame body;
a vibration body provided in the frame body in a state where a tensile force is applied to the vibration body; and
a piezoelectric vibration element provided on the vibration body, wherein
when a first direction and a second direction are directions along a main surface of the vibration body and intersect with each other,
both ends in the first direction of the vibration body and both ends in the second direction of the vibration body are fixed to the frame body,
a length in the first direction of the vibration body is longer than a length in the second direction of the vibration body, and
the tensile force in the first direction is larger than the tensile force in the second direction.

9. An electronic apparatus comprising:
a case;
a sound generator being provided in the case; and
an electronic circuit connected to the sound generator,
the sound generator comprising:
a frame body;
a vibration body provided in the frame body in a state where a tensile force is applied to the vibration body; and a piezoelectric vibration element provided on the vibration body, wherein when a first direction and a second direction are directions along a main surface of the vibration body and intersect with each other, both ends in the first direction of the vibration body and both ends in the second direction of the vibration body are fixed to the frame body, a length in the first direction of the vibration body is longer than a length in the second direction of the vibration body, the tensile force in the first direction is larger than the tensile force in the second direction, and the electronic apparatus has a function of generating sound from the sound generator.

* * * * *